US010822675B2

(12) United States Patent
Sanaty-Zadeh et al.

(10) Patent No.: US 10,822,675 B2
(45) Date of Patent: Nov. 3, 2020

(54) HIGH TEMPERATURE CREEP RESISTANT ALUMINUM SUPERALLOYS

(71) Applicant: NanoAL LLC, Ashland, MA (US)

(72) Inventors: Amirreza Sanaty-Zadeh, Madison, WI (US); Nhon Q. Vo, Skokie, IL (US)

(73) Assignee: NanoAL LLC, Ashland, MA (US)

( * ) Notice: Subject to any disclaimer, the term of this patent is extended or adjusted under 35 U.S.C. 154(b) by 1104 days.

(21) Appl. No.: 15/062,105

(22) Filed: Mar. 5, 2016

(65) Prior Publication Data

US 2016/0258042 A1 Sep. 8, 2016

Related U.S. Application Data

(60) Provisional application No. 62/129,311, filed on Mar. 6, 2015.

(51) Int. Cl.

| | |
|---|---|
| ***C22C 21/00*** | (2006.01) |
| ***C22F 1/04*** | (2006.01) |
| ***C21D 9/00*** | (2006.01) |
| ***C21D 1/18*** | (2006.01) |

(52) U.S. Cl.

CPC ..... *C22C 21/00* (2013.01); *C21D 1/18* (2013.01); *C21D 9/0068* (2013.01); *C22F 1/04* (2013.01)

(58) Field of Classification Search

CPC ..... C22C 21/00

See application file for complete search history.

(56) References Cited

U.S. PATENT DOCUMENTS

| | | | | |
|---|---|---|---|---|
| 3,551,143 | A | 12/1970 | Marukawa et al. | |
| 3,807,969 | A | 4/1974 | Schoerner et al. | |
| 5,327,955 | A | 7/1994 | Easwaran | |
| 5,449,421 | A | 12/1995 | Hamajima et al. | |
| 5,489,347 | A * | 2/1996 | Himuro | C22C 21/00 148/437 |
| 5,976,214 | A | 11/1999 | Kondoh et al. | |
| 6,149,737 | A | 11/2000 | Hattori et al. | |
| 6,460,598 | B1 * | 10/2002 | Adams | B22D 19/0072 164/30 |
| 6,592,687 | B1 | 7/2003 | Lee et al. | |
| 6,918,970 | B2 | 7/2005 | Lee et al. | |
| 8,323,373 | B2 | 12/2012 | Haynes, III et al. | |
| 2003/0192627 | A1 | 10/2003 | Lee et al. | |
| 2010/0143177 | A1 | 6/2010 | Pandey | |
| 2011/0017359 | A1 | 1/2011 | Pandey | |
| 2013/0199680 | A1 | 8/2013 | Apelian et al. | |
| 2013/0220497 | A1 | 8/2013 | Huskamp et al. | |

FOREIGN PATENT DOCUMENTS

EP 0 558 957 A2 9/1993

OTHER PUBLICATIONS

Jun. 25, 2015 International Search Report for PCT/US2015/020218.

Jun. 25, 2015 Written Opinion of International Searching Authority for PCT/US2015/020218.

May 4, 2016 Office Action in connection with U.S. Appl. No. 14/645,654.

Jun. 6, 2016 Transmittal of International Search Report and Written Opinion of International Searching Authority for PCT/US2016/021094.

A.L. Berezina et al., "Decomposition Processes in the Anomalous Supersaturated Solid Solution of Binary and Ternary Aluminum Alloys Aloyed with Sc and Zr," *Acta Physica Polonica A*, vol. 122, No. 3, pp. 539-543 (Sep. 8, 2011).

C. Booth-Morrison et al., "Effect of Er Addition on ambient and high-temperature strength of precipitation-strengthened Al—Zr—Sc—Si alloys," *Acta Mater* 60, 3643-3654 (2012).

C. Booth-Morrison et al., "Role of Silicon in Accelerating the Nucleation of $Al_3$(Sc,Zr) Precipitates in Dilute Al—Sc—Zr Alloys," *Acta Mater* 60, 4740-4752 (2012).

C. B. Fuller et al., "Temporal Evolution of the Nanostructure of Al(Sc,Zr) Alloys: Part I—Chemical Compositions of Al3($Sc_{1-x}Zr_x$) Precipitates," *Acta Mater* 53, 5401-5413 (2005).

H. Hallem et al., "The Formation of Al3$Sc_xZr_yHf_{1-x-y}$) Dispersoids in Aluminium Alloys," *Mater Sci Eng A* 421, 154-160 (2006).

S. Hori et al., "Effect of Small Addition of Si on the Precipitation of Al—0.6%Zr Alloys," *J Jpn Inst Light Met* 28, 79-84 (1978).

H. Huang et al., "Age Hardening Behavior and Corresponding Microstructure of Dilute Al—Er—Zr Alloys," *Metall and Mater Trans A* 44A, 2849-2856 (2013).

K. E. Knipling et al., "Ambient- and High-Temperature Mechanical Properties of Isochronally Aged Al—0.06Sc, Al—0.06Zr and Al—0.06Sc—0.06Zr (at.%) Alloys," *Acta Mater* 59, 943-954 (2011).

K.E. Knipling et al., "Atom-Probe Tomographic Studies of Precipitation in Al—0.1Zr—0.1Ti (at.%) Alloys," *Microscopy and Microanalysis* 13, 1-14 (2007).

K.E. Knipling et al., "Creep resistance of cast and aged Al—0.1Zr and Al—0.1Zr—0.1Ti (at. %) alloys at 300-400° C.," *Scrpta Materialia* 59, 387-390 (2008).

K. E. Knipling et al., "Criteria for Developing Castable, Creep-Resistant Aluminum-Based Alloys—A Review," *Z Metallkd* 97, 246-265 (2006).

(Continued)

*Primary Examiner* — Christopher S Kessler

(57) ABSTRACT

This invention relates to a series of castable aluminum alloys with excellent creep and aging resistance, high electrical conductivity and thermal conductivity at elevated temperatures. The cast article comprises 0.4 to 2% by weight iron, 0 to 4% by weight nickel, 0.1 to 0.6 or about 0.1 to 0.8% by weight zirconium, optional 0.1 to 0.6% by weight vanadium, optional 0.1 to 2% by weight titanium, at least one inoculant such as 0.07-0.15% by weight tin, or 0.07-0.15% by weight indium, or 0.07-0.15% by weight antimony, or 0.02-0.2% by weight silicon, and aluminum as the remainder. The aluminum alloys contain a simultaneous dispersion of $Al_6Fe$, $Al_3X$ (X=Fe, Ni) and/or $Al_9FeNi$ intermetallic in the eutectic regions and a dispersion of nano-precipitates of $Al_3Zr_xV_yTi_{1-x-y}$ ($0 \le x \le 1$, $0 \le y \le 1$ and $0 \le x+y \le 1$) having $L1_2$ crystal structure in the aluminum matrix in between the eutectic regions. The processing condition for producing cast article of the present invention is disclosed in detail.

31 Claims, 5 Drawing Sheets

(56) References Cited

OTHER PUBLICATIONS

K.E. Knipling et al., "Nucleation and Precipitation Strengthening in Dilute Al—Ti and Al—Zr Alloys," *Matallurgical and Materials Transactions A* 38A, 2552-2563 (2007).
K. E. Knipling et al., "Precipitation Evolution in Al—0.1Sc, Al—0.1Zr, and Al—0.1Sc—0.1Zr (at.%) Alloys during Isochronal Aging," *Acta Mater* 58, 5184-5195 (2010).
K.E. Knipling et al., "Precipitation Evolution in Al—Zr and Al—Zr—Ti Alloys during Isothermal aging at 375-425° C.," *Acta Mater* 56, 114-127 (2008).
K.E. Knipling et al., "Precipitation Evolution in Al—Zr and Al—Zr—Ti Alloys during Isothermal aging at 450-600° C.," *Acta Mater* 56, 1182-1195 (2008).
A. D. LeClaire et al., "3.2.13 Aluminum group metals," *Diffusion in Solid Metals and Alloys* (H. Mehrer (ed.)) Springer Materials—Landolt-Börnstein—Group III Condensed Matter, vol. 26, 151-156 (1990).
H. Li et al., "Precipitation Evolution and Coarsening Resistance at 400° C. of Al microalloyed with Zr and Er," *Scr Mater* 67, 73-76 (2012).
T. Ohashi et al., "Effect of Fe and Si on Age Hardening Properties of Supersaturated Solid Solution of Al—Zr Alloy by Rapid Solidification," *J Jpn. Inst Met* 34, 604-610 (1970).
Y.W. Riddle et al., "A Study of coarsening, Recrystalization, and Morphology of Microstructure in Al—Sc—[Zr]—[Mg] Alloys," *Metallurgical and Materials Transactions A*, vol. 35A, pp. 341-350 (Jan. 2004).
T. Sato et al., "Effects of Si and Ti Addition on the Nucleation and Phase Stability of the $Ll_2$-Type $Al_3Zr$ Phase in Al—Zr Alloys," *Mater Sci Forum*, 217-222, 895-900 (1996).
D. N. Seidman et al., "Precipitation Strengthening at Ambient and Elevated Temperatures of Heat-Treatable Al(Sc) Alloys," *Acta Mater* 50, 4021-4035 (2002).
M. E. van Dalen et al., "Effects of Ti Additions on the Nanostructure and Creep Properties of Precipitation-Strengthened Al—Sc Alloys," *Acta Mater* 53, 4225-4235 (2005).
S. P. Wen et al., "Synergetic Effect of Er and Zr on the Precipitation Hardening of Al—Er—Zr Alloy," *Scr Mater* 65, 592-595 (2011).
Y Zhang et al., "Precipitation Evolution of Al—Zr—Yb Alloys during Isochronal Aging," *Scr Mater* 69, 477-480 (2013).

* cited by examiner

HIGH TEMPERATURE CREEP RESISTANT ALUMINUM SUPERALLOYS

CROSS-REFERENCE TO RELATED APPLICATIONS

This application claims priority to and the benefit of and U.S. Provisional Application No. 62/129,311 entitled "High Temperature Creep Resistant Aluminum Superalloys," filed Mar. 6, 2015, the disclosure of which is hereby incorporated by reference in its entirety.

FIELD

The invention presented herein targets a new series of "aluminum superalloys" that are heat resistant and creep resistant at temperatures as high as 400° C. (752° F.) and that have high electrical conductivity and high thermal conductivity (at least 45% of annealed copper). The alloy can be fabricated through conventional casting method and is age-hardened and dispersion-hardened.

BACKGROUND OF THE INVENTION

Aluminum alloys are one of the most common components of the light structures in aerospace, automotive, nuclear, and conductor wire and cable industry. However, in most cases, commercial aluminum alloys produced through conventional casting are not able to operate beyond 220° C. (428° F.). This is due to degradation of the microstructure by either dissolution or coarsening of the strengthening phase. Examples of such alloys include cast aluminum alloy 2xx.x, containing copper, 3xx.x, containing silicon and magnesium, and 7xx.x, containing zinc as the main alloying elements. Recent efforts have been made by researchers to produce aluminum alloys that contain scandium, which show improved mechanical properties at elevated temperatures. However, due to limited resources and production for scandium and very high cost of this element, the designed alloys have not found mass applications. Currently, traditional cast aluminum alloys are not capable of operating in applications such as automotive brake rotors, high power conductor wires and cables, engine components, and structural components in nuclear spent fuel storages, where good strength and high creep resistance are required at elevated temperatures as high as 400° C. (662° F.).

There have previously been attempts to produce aluminum alloys that can operate at elevated temperatures. The following patents represent some of these efforts:

J. A. Lee, "HIGH STRENGTH ALUMINUM ALLOY FOR HIGH TEMPERATURE APPLICATIONS" Patent No. U.S. Pat. No. 6,918,970, 2005.

D. Apelian. M. M. Makhlouf "ALUMINUM DIE CASTING ALLOY" Patent No. US 2013/0199680 AL, 2013.

C. S. Huskamp, C. Booth-Morrison, D. C. Dunand, D. N. Seidman, J. M. Boileau, B. Ghaffari, "ALUMINIUM ALLOY WITH ADDITIONS OF SCANDIUM, ZIRCONIUM AND ERBIUM" US 2013/0220497, filed 29 Aug. 2013.

Among these alloys, NASA series (U.S. Pat. No. 6,918,970) have found their way to industrial applications such as automotive engine components. These alloys are mainly improved 3xx.x cast aluminum alloys containing high Si content. Examples are NASA 358, 388 and 398, which comprise 6-25 wt. % Si and 5-8 wt. % Cu as the main alloying elements. The best performance NASA 398 alloy is claimed to be able to operate in the temperature range of 260-371° C. (500-700° F.).

From the preceding patent, it is realized that the high-temperature stability for these alloys originates from the presence of three different types of precipitates in the system namely $Al_2Cu$ (θ'), $Al_2CuMg$ (S'), and heat-resistant $Al_3X$ (X=Ti, V, Zr). The first two types are stabilized by: i) controlling the ratio of Cu/Mg in the alloy; and ii) simultaneous addition of transition metals such as Ti, V, and Zr. The patent states that its alloy shows good thermal stability at temperatures as high as 371° C. (700° F.). The published specifications on this material (NASA 398 alloy), however, show a very low thermal conductivity (120-130 W/m·K) in the temperature range of 25-371° C. (700° F.) and very low ductility (0.4% at 25° C. (77° F.) and 4.5% at 371° C. (700° F.)) which hinders its applications. Although these materials have excellent wear properties and high strength at room and elevated temperatures, they are not suitable for applications where high electrical and thermal conductivity and medium to high ductility are required. Such applications include: i) electricity and heat conductors in power transfer industry; ii) brake rotors and cylinder heads in automotive industry, and iii) interior compartments of the spent fuel storage canisters in nuclear industry.

Other production methods rather than traditional casting such as rapid solidification (RS) and powder metallurgy (PM) have also been utilized in producing aluminum alloys with outstanding properties at ambient and elevated temperatures. For example, Metamic-HT, an aluminum composite containing $Al_2O_3$ and $B_4C$ particles have outstanding mechanical properties and thermal conductivity at elevated temperatures as high as 350° C. (662° F.). However, the processing routes for such products are often very complicated and costly and cannot be scaled up for mass production.

SUMMARY OF INVENTION

Aluminum alloys are disclosed that have outstanding creep resistance, electrical conductivity and thermal conductivity at room temperature and elevated-temperatures. The alloys include about 0.4 to 2% by weight iron; about 0.1 to 0.8% by weight zirconium; about 0.07-0.15% by weight tin, indium or antimony; about 0.02-0.2% by weight silicon with aluminum as the remainder. Certain compositions can further include nickel at a concentration of up to about 4% by weight. Aluminum cast articles prepared from the disclosed aluminum alloys are also disclosed. In certain embodiments the alloys lack scandium.

In certain embodiments the aluminum alloy preferably include about 0.5 to 1.5% by weight iron and about 0.5 to 3.5% by weight nickel. Such alloys have superior electrical and thermal conductivity and better ductility while maintaining other superior properties.

In certain embodiments the aluminum alloy preferably include about 0.25 to 0.55% by weight zirconium. Such alloys can be prepared under casting conditions with moderate cooling rates after solidification.

In certain embodiments the aluminum alloy can include about 0.5 to 1.5% by weight iron, about 0.5 to 3.5% by weight nickel and about 0.25 to 0.55% by weight zirconium.

In certain embodiments the aluminum alloy preferably include about 0.27 to 0.42% by weight zirconium. Such alloys can be prepared under casting conditions with slow to moderate cooling rates after solidification.

In certain embodiments the aluminum alloy can include about 0.5 to 1.5% by weight iron, about 0.5 to 3.5% by weight nickel and about 0.27 to 0.42% by weight zirconium.

In certain embodiments the aluminum alloy can include about 0.5 to 1.5% by weight iron and about 1 to 3% by weight nickel.

In certain embodiments the aluminum alloy can include about 0.5 to 1.5% by weight iron, about 1 to 3% by weight nickel and about 0.25 to 0.55% by weight zirconium.

In certain embodiments the aluminum alloy can include about 0.5 to 1.5% by weight iron, about 1 to 3% by weight nickel and about 0.27 to 0.42% by weight zirconium.

In certain embodiments the aluminum alloy preferably includes about 0.82 to 1.22% by weight iron and about 1.65 to 2.35% by weight nickel. Such alloys provide superior thermal and electrical conductivities along with high ductility while maintaining other superior properties.

In certain embodiments the aluminum alloy can include about 0.82 to 1.22% by weight iron, about 1.65 to 2.35% by weight nickel and about 0.25 to 0.55% by weight zirconium.

In certain embodiments the aluminum alloy can include about 0.82 to 1.22% by weight iron, about 1.65 to 2.35% by weight nickel and about 0.27 to 0.42% by weight zirconium.

In certain embodiments the aluminum alloy can include nickel at a concentration of up to about 4% by weight and about 0.25 to 0.55% by weight zirconium.

In certain embodiments the aluminum alloy can include nickel at a concentration of up to about 4% by weight and about 0.27 to 0.42% by weight zirconium.

In certain embodiments the aluminum alloy can include about 0.1 to 0.6% by weight vanadium.

In certain embodiments the aluminum alloy can include about 0.1 to 2% by weight titanium.

In certain embodiments the aluminum alloy can include about 0.1 to 0.6% by weight vanadium and about 0.1 to 2% by weight titanium.

In certain embodiments the aluminum alloy can include a dispersion of intermetallic $Al_6Fe$, $Al_3X$ (X=Fe, Ni) and $Al_9FeNi$ in intermetallic phases having an average diameter of about 200-600 nm.

In certain embodiments the aluminum alloy can include a dispersion of $Al_3Zr_xV_yTi_{1-x-y}$ ($0 \le x \le 1$, $0 \le y \le 1$ and $0 \le x+y \le 1$) nano-precipitates, having the $L1_2$ crystal structure and an average diameter in the range of about 6-40 nm.

In certain embodiments the aluminum alloy can include nickel at a concentration of up to about 4% by weight and a dispersion of intermetallic $Al_6Fe$ and/or $Al_3Fe$ in intermetallic phases having an average diameter of about 200-600 nm.

In certain embodiments the aluminum alloy can include nickel at a concentration of up to about 4% by weight, a dispersion of intermetallic $Al_6Fe$, $Al_3X$ (X=Fe, Ni) and $Al_9FeNi$ in intermetallic phases having an average diameter of about 200-600 nm, and a dispersion of $Al_3Zr_xV_yTi_{1-x-y}$ ($0 \le x \le 1$, $0 \le y \le 1$ and $0 \le x+y \le 1$) nano-precipitates having $L1_2$ crystal structure and an average diameter in the range of about 6-40 nm.

In certain embodiments the aluminum alloy can include a dispersion of intermetallic $Al_6Fe$ and/or $Al_3Fe$ in intermetallic phases having an average diameter of about 200-600 nm and a dispersion of $Al_3Zr_xV_yTi_{1-x-y}$ ($0 \le x \le 1$, $0 \le y \le 1$ and $0 \le x+y \le 1$) nano-precipitates having $L1_2$ crystal structure and an average diameter in the range of about 6-40 nm.

In certain embodiments the aluminum alloy can include filler materials or reinforcement materials selected from the group of materials consisting of silicon carbide (SiC), aluminum oxide ($Al_2O_3$), boron carbide ($B_4C$), boron nitride (BN), titanium carbide (TiC), yttrium oxide ($Y_2O_3$), graphite, diamond particles, and their mixtures, the volume fraction of the filler materials comprising up to about 25% by volume of the metal matrix.

In certain embodiments the aluminum alloy can nickel at a concentration of up to about 4% by weight; filler materials or reinforcement materials selected from the group of materials consisting of silicon carbide (SiC), aluminum oxide ($Al_2O_3$), boron carbide ($B_4C$), boron nitride (BN), titanium carbide (TiC), yttrium oxide ($Y_2O_3$), graphite, diamond particles, and their mixtures, the volume fraction of the filler materials comprising up to about 25% by volume.

In certain embodiments the aluminum alloy can be an aluminum cast article comprising a dispersion of intermetallic $Al_6Fe$, $Al_3X$ (X=Fe, Ni) and $Al_9FeNi$ in intermetallic phases having an average size range of about 200-600 nm and a dispersion of $Al_3Zr_xV_yTi_{1-x-y}$ ($0 \le x \le 1$, $0 \le y \le 1$ and $0 \le x+y \le 1$) nano-precipitates having $L1_2$ crystal structure and an average size range of about 6-40 nm.

Methods for manufacturing the aluminum metal matrix are also disclosed. The method includes casting at about 750 to 950° C. an alloy mixture of about 0.4 to 2% by weight iron; about 0.1 to 0.8% by weight zirconium; about 0.07-0.15% by weight tin, indium or antimony; about 0.02-0.2% by weight silicon, and an inoculant selected from the group of inoculants consisting of Sn, In, Sb and their mixtures; with aluminum as the remainder. The cast alloy can be quenched after solidification and can be aged at a temperature in the range of about 300 to 450° C. for about 2 to 72 hours.

In certain manufacturing methods aging can be at about 400 to 450° C. for about 24 to 72 hours.

In certain manufacturing methods the alloy mixture lacks scandium.

One embodiment of the present invention is an aluminum cast article with outstanding creep resistance, electrical conductivity and thermal conductivity at elevated temperatures. The cast article comprises:

about 0.4 to 2% by weight iron
0 to about 4% by weight nickel
about 0.1 to 0.6% or about 0.1 to 0.8% by weight zirconium
optionally about 0.1 to 0.6% by weight vanadium
optionally about 0.1 to 2% by weight titanium
about 0.07-0.15% by weight tin or about 0.07-0.15% by weight indium or about 0.07-0.15% by weight antimony,
about 0.02-0.2% by weight silicon, and
aluminum as the remainder.

Another embodiment of the present invention is a cast article with the aluminum alloy described above, further comprising a dispersion of intermetallic $Al_6Fe$, $Al_3X$ (X=Fe, Ni) and $Al_9FeNi$ intermetallic phases with an average diameter in the range of about 200-600 nm.

Another embodiment of the present invention is a cast article with the aluminum alloy described above, comprising a dispersion of $Al_3Zr_xV_yTi_{1-x-y}$ ($0 \le x \le 1$, $0 \le y \le 1$ and $0 \le x+y \le 1$) nano-precipitates, having $L1_2$ crystal structure with an average diameter range of about 6-20 or about 6-40 nm.

Another embodiment of the present invention is a cast article with the aluminum alloy described above, comprising about 0.4-2% by weight iron.

Another embodiment of the present invention is a cast article with the aluminum alloy described above, comprising about 0.5 to 4% by weight nickel.

Another embodiment of the present invention is a cast article with the aluminum alloy described above, comprising about 0.1 to 0.6% or about 0.1 to 0.8% by weight zirconium.

Another embodiment of the present invention is a cast article with the aluminum alloy described above, comprising about 0.07-0.15% by weight tin or about 0.07-0.15% by weight indium or about 0.07-0.15% by weight antimony.

Another embodiment of the present invention is a cast article with the aluminum alloy described above, comprising about 0.02-0.2% by weight silicon.

Another embodiment of the present invention is a cast article with the aluminum alloy described above, comprising about 0.1 to 0.6% by weight vanadium and about 0.1 to 2% by weight titanium.

Another embodiment of the present invention is a metal matrix having the composition about 0.4 to 2% by weight iron 0 to about 4% by weight nickel about 0.1 to 0.6% or about 0.1 to 0.8% by weight zirconium optionally about 0.1 to 0.6% by weight vanadium optionally about 0.1 to 2% by weight titanium about 0.07-0.15% by weight tin or about 0.07-0.15% by weight indium or about 0.07-0.15% by weight antimony, about 0.02-0.2% by weight silicon, and aluminum as the remainder and further comprising a dispersion of intermetallic $Al_3X$ (X=Fe, Ni) and $Al_9FeNi$ intermetallic phases with an average diameter in the range of about 200-600 nm and the dispersion of $Al_3Zr_xV_yTi_{1-x-y}$ ($0 \le x \le 1$, $0 \le y \le 1$ and $0 \le x+y \le 1$) nano-precipitates, having $L1_2$ crystal structure and an average diameter range of about 6-20 or about 6-40 nm. The metal matrix can contain filler materials or reinforcement materials including silicon carbide (SiC), aluminum oxide ($Al_2O_3$), boron carbide ($B_4C$), boron nitride (EN), titanium carbide (TiC), yttrium oxide ($Y_2O_3$), graphite, diamond particles, and any combination of these particles. The volume fraction of the filler materials can vary up to about 25% by volume.

DETAILED DESCRIPTION OF THE INVENTION

Figure 1A:
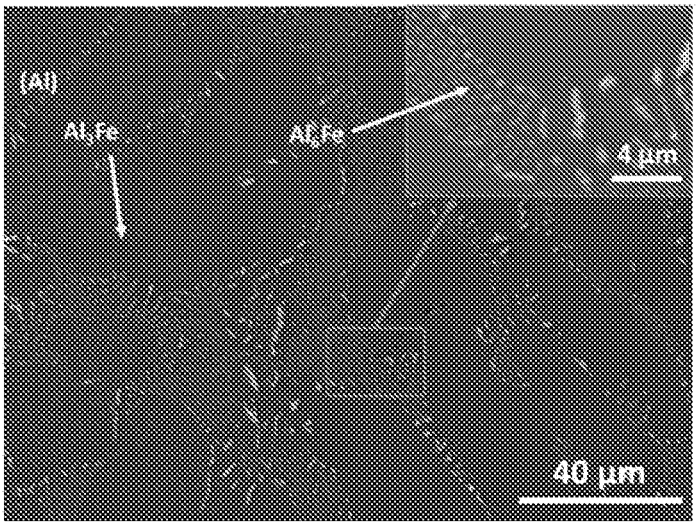
FIGS. 1. (A) and (B) are images from the scanning electron microscopic technique showing the interdendritic $Al_6Fe$, $Al_3X$ (X=Fe, Ni) and $Al_9FeNi$ dispersoids in the invented aluminum alloy.
Figure 1B:
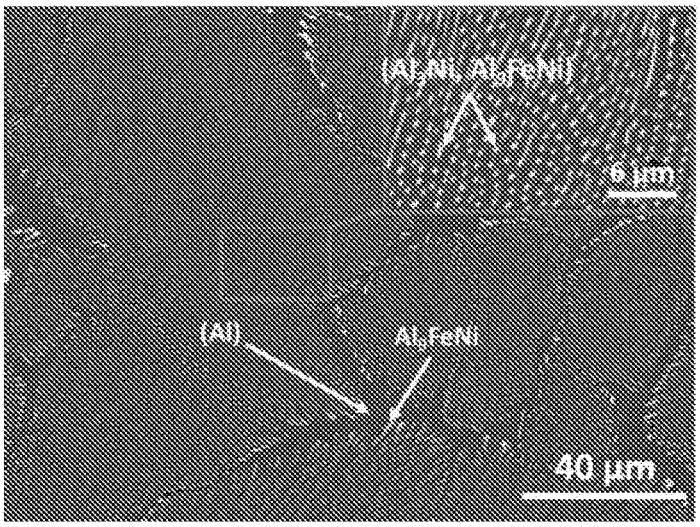

A series of heat resistant castable aluminum alloys with excellent creep and aging resistance and high electrical and thermal conductivity are disclosed. The outstanding creep resistance for these alloys results from: i) the presence of $Al_3Zr_xV_yTi_{1-x-y}$ ($0 \le x \le 1$, $0 \le y \le 1$ and $0 \le x+y \le 1$) nano-precipitates with $L1_2$ crystal structure and the average diameter in the range of about 6-20 or about 6-40 nm, and ii) the reinforcement phase in the form of $Al_6Fe$, $Al_3X$ (X=Ni, Fe) and $Al_9FeNi$ intermetallic precipitates with an average diameter in the range of about 200-600 nm. The average diameter of the reinforcement phase and nano-precipitates are measured via scanning electron microscopy (SEM) and atom probe tomography (APT) techniques, respectively. For SEM measurements, at least three images from three different regions are analyzed by means of common image analysis software to obtain the diameter of the captured intermetallic phase, and the average diameter is recorded for all captured intermetallics. For APT analysis, the obtained data is analyzed utilizing IVAS™ software to reconstruct the studied volume three-dimensionally that include nano-precipitates. The average diameter of the captured nano-precipitates is measured by the same software. The presence of $Al_3X$ (X=Fe, Ni) precipitates in the interdendritic regions and $Al_3Zr_xV_yTi_{1-x-y}$ ($0 \le x \le 1$, $0 \le y \le 1$ and $0 \le x+y \le 1$) nano-precipitates in the dendritic regions creates a strong pinning force against dislocation motions at ambient and elevated temperatures. Since both hardening phases are thermally stable, the mechanical properties are maintained at elevated temperatures as high as 400° C. (752° F.).

The alloys disclosed herein are advantageous since they can be produced via low cost traditional casting method. In addition, utilizing low alloying element concentrations to produce these alloys allows superior electrical and thermal conductivity (at least 45% of annealed copper).

Another advantage is that these alloys are produced without using scandium as an alloying element, which results in a very low alloy cost.

The high number density of $Al_3Zr_xV_yTi_{1-x-y}$ ($0 \le x \le 1$, $0 \le y \le 1$ and $0 \le x+y \le 1$) nano-precipitates, with the average diameter in the range of about 6-20 or about 6-40 nm, is produced by introducing an inoculant element into the alloy. The inoculant elements used in the invented alloys include Sn, In, and Sb. Thus the presence of the inoculant elements is important to obtain good strength and creep resistance at ambient and elevated temperatures.

The disclosed aluminum alloys provide light weight, low cost, highly electrically and thermally conductive, heat resistant, and creep resistant properties that are thermally stable in the temperature range of about 25-400° C. (about 77-752° F.).

These properties are achieved by aluminum alloys produced through traditional casting that contain:

0.4 to 2% by weight iron, 0 to 4% by weight nickel, 0.1 to 0.6 or 0.1 to 0.8% by weight zirconium, Optionally 0.1 to 0.6% by weight vanadium, Optionally 0.1 to 2% by weight titanium, 0.07-0.15% by weight tin or 0.07-0.15% by weight indium, or 0.07-0.15% by weight antimony, 0.02-0.2% by weight silicon.

The present invention comprises a series of aluminum alloys with combination of outstanding creep resistance and high electrical and thermal conductivity at ambient and elevated temperatures. The invented alloys are marked by an ability to perform in cast form, which is suitable for elevated temperatures. The high creep resistance of the invented alloys results from two main strengthening mechanisms: the intermetallic dispersion hardening and nano-precipitation hardening.

The intermetallic dispersion hardening relies on the formation of dispersed intermetallic phase in the interdendritic regions during solidification. In the present invention, about 0.4-2% by weight iron and about 0-4% by weight nickel is utilized to form a fine dispersion of $Al_6Fe$, $Al_3X$ (X=Fe, Ni) and $Al_9FeNi$ intermetallic phases in the interdendritic regions. The volume fraction, shape, and diameter of $Al_3X$ (X=Fe, Ni) and $Al_9FeNi$ intermetallic phases depend on the concentration of Fe and Ni, the Fe/Ni concentration ratio, and the specific heat treatment conditions. FIGS. 1(A) and (B) show a distribution of such intermetallic phases in the aluminum alloy produced according to the present invention.

The nano-precipitation hardening relies on the formation of nano-precipitates in the aluminum matrix through specific heat treatment conditions. In the present invention, about 0.1 to 0.6 or about 0.1 to 0.8% by weight zirconium, about 0.1 to 0.6% by weight vanadium, and about 0.1-2% by weight titanium are used to create a high number density of coherent $L1_2$ $Al_3Zr_xV_yTi_{1-x-y}$ ($0 \le x \le 1$, $0 \le y \le 1$ and $0 \le x+y \le 1$) nano-precipitates in the aluminum alloy. Since the atomic radius of vanadium (0.132 nm) is smaller than zirconium (0.159 nm) and titanium (0.176 nm), the lattice mismatch of the $Al_3Zr_xV_yTi_{1-x-y}$ ($0 \le x \le 1$, $0 \le y \le 1$ and $0 \le x+y \le 1$) type precipitates can be reduced to closely match the lattice parameter of aluminum matrix. As a result, the coarsening resistance of the precipitates can be further increased by controlled addition of vanadium and titanium to zirconium-containing alloy. The volume fraction, diameter, and lattice mismatch of $Al_3Zr_xV_yTi_{1-x-y}$ ($0 \le x \le 1$, $0 \le y \le 1$ and $0 \le x+y \le 1$) nano-precipitates depend on the concentration of Zr, V, and Ti, the corresponding Zr:V:Ti concentration ratio, and the specific heat treatment conditions.

compared to the scandium-containing alloys. It is noted that the threshold stress of the cast articles produced according to this invention, is at least 60% higher than that of the scandium-containing alloys, tested at 400° C. (752° F.). The threshold stress is the one below which no observable creep occurs in the alloy.

Generally, the invented alloys after optimal processing contain about 0.3-0.8% by volume fraction $Al_3Zr_xV_yTi_{1-x-y}$ ($0 \le x \le 1$, $0 \le y \le 1$ and $0 \le x+y \le 1$), and about 0-20% by volume fraction $Al_3X$ (X=Fe, Ni) and $Al_9FeNi$.

In order to activate the strengtheners and achieve outstanding mechanical properties, the cast articles must have specific chemical compositions and heat treatments. These conditions are designed to maximize the strengthening effects through optimized formation of $Al_3Zr_xV_yTi_{1-x-y}$ ($0 \le x \le 1$, $0 \le y \le 1$ and $0 \le x+y \le 1$), $Al_3X$ (X=Fe, Ni), and $Al_9FeNi$ phases.

Figure 3:
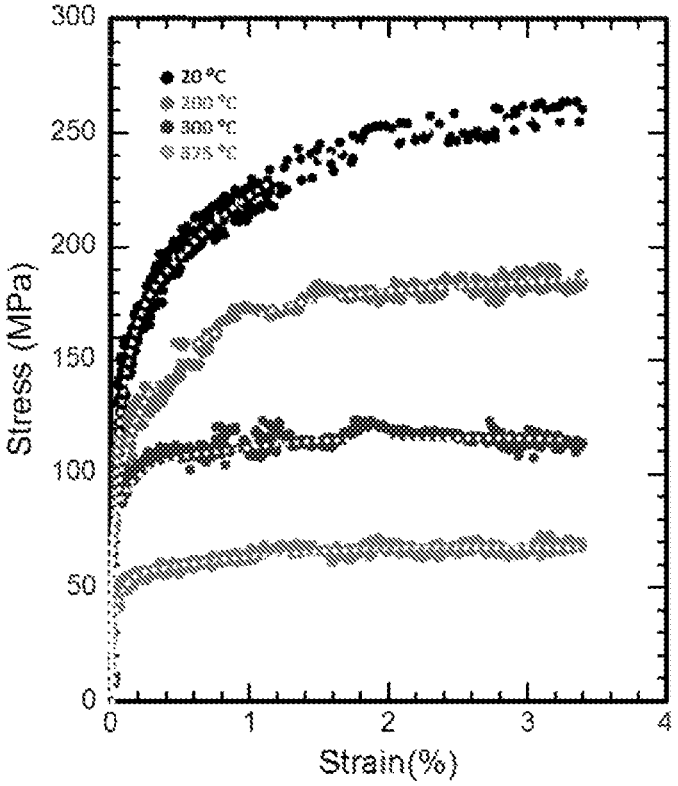
FIG. 3. shows compression stress strain curves of an example of the invented aluminum alloys at different testing temperatures of 20° C. (RT), 100° C., 200° C., and 375° C. The alloy is at T5 condition prior to testing.

The high-temperature strength is achieved in the present invention when using a T5 heat treatment consisting of aging at 400-450° C. (752-842° F.) for 24 to 72 hours. The unique composition and the corresponding heat treatment allow nearly full precipitation of $Al_3Zr_xV_yTi_{1-x-y}$ ($0 \le x \le 1$, $0 \le y \le 1$ and $0 \le x+y \le 1$) nano-precipitates with high number density and average diameter in the range of 6-20 or 6-40 nm. Additionally, the fragmentation of the nickel-iron intermetallic phases during the heat treatment allows further improvement in ductility while maintaining the strength. FIG. 3 shows compression stress strain curves of an example of the invented aluminum alloys at different testing temperatures of 20° C. (RT), 100° C., 200° C., and 375° C. The alloy is at T5 condition prior to testing. Additionally, table 1 summarizes the values obtained from stress strain curves for the example alloy. At testing temperature of 375° C., as observed, compression yield and compression strength of 55 and 67 MPa are obtained for the example alloy, respectively, using the designed heat treatment conditions.

TABLE. 1

| Specs. | 0.2% $\sigma_Y$ (MPa) | | | | Compressive Strength (MPa) | | | | Thermal conductivity (W/m · K) | |
|---|---|---|---|---|---|---|---|---|---|---|
| Testing temp. | RT | 200° C. | 300° C. | 375° C. | RT | 200° C. | 300° C. | 375° C. | RT | 375° C. |
| Alloy | 167 | 125 | 102 | 55 | 259 | 184 | 113 | 63 | 185 | — |

[1] values in compressive mode

The high creep resistance of the invented alloys relies on the presence of the heat resistant $Al_6Fe$, $Al_3X$ (X=Fe, Ni), and $Al_9FeNi$ intermetallic phases and the heat resistant $Al_3Zr_xV_yTi_{1-x-y}$ ($0 \le x \le 1$, $0 \le y \le 1$ and $0 \le x+y \le 1$) nano-precipitates. While the former contributes to strengthening of the interdendritic regions, the latter strengthens the dendritic regions. The strengtheners create barriers to dislocation glide and dislocation climb (i.e. the main creep mechanism) at elevated temperatures.

Figure 2:
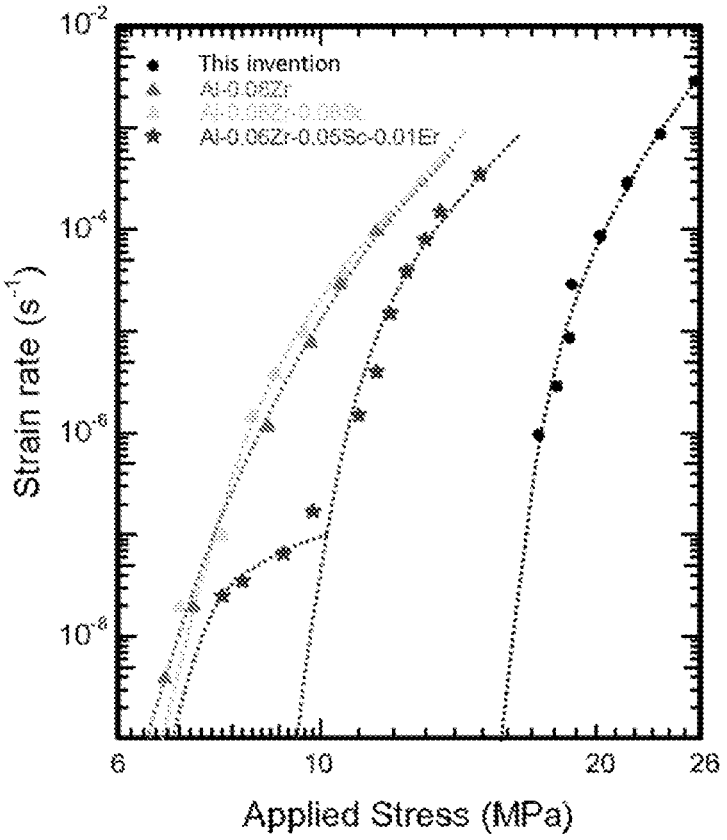
FIG. 2. is a graphical illustration of the excellent creep resistance of an example of the invented aluminum alloys compared with the prior art, scandium-containing aluminum alloys. The testing temperature for all alloys present in the graph is 400° C. (752° F.).
Figure 4:
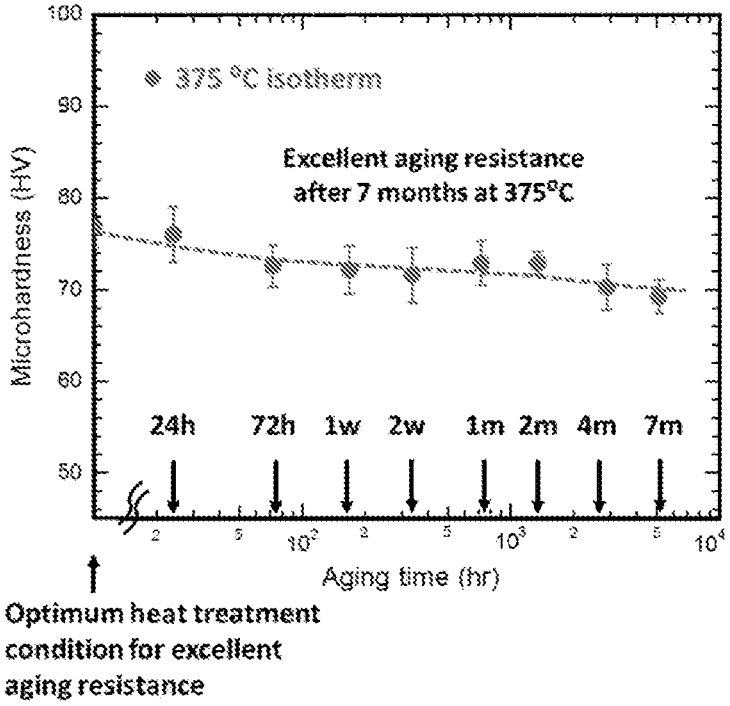
FIG. 4. is a graphical illustration of the excellent aging resistance of an example of the invented aluminum alloys at 375° C. operating temperature for 7 months.

The specific concentration of alloying elements and heat treatment conditions are necessary to create the desired microstructure with desired diameter and volume fraction of both nickel-iron intermetallic phases and $Al_3Zr_xV_yTi_{1-x-y}$ ($0 \le x \le 1$, $0 \le y \le 1$ and $0 \le x+y \le 1$) nano-precipitates. FIG. 2 is a graph showing a comparison of an alloy according to the present invention with three alloys of prior art. The testing temperature for all alloys present in the graph is 400° C. (752° F.). The graph shows the outstanding creep resistance of the cast alloy produced according to this invention The aging-resistance of the present invention stems from the presence of heat resistant $Al_6Fe$, $Al_3X$ (X=Fe, Ni) and $Al_9FeNi$ intermetallic phases, and $Al_3Zr_xV_yTi_{1-x-y}$ ($0 \le x \le 1$, $0 \le y \le 1$ and $0 \le x+y \le 1$) nano-precipitates. The aging resistance is described as the retained room temperature strength after exposure to high temperature for several months. FIG. 4 shows an excellent aging resistance of the example alloy of this invention at 375° C. (707° F.). No drop in strength was observed for this alloy after 7 months exposure to 375° C. (707° F.).

The alloys produced according to the present invention are processed using traditional casting. The casting temperature is in the range of 750-950° C. (1382-1742° F.). The cast alloys are quenched in a quenching medium after solidification to maximize the content of solute atoms in the solid solution. This allows cooling rate that exceeds 10° C./s (50° F./s). The most preferred quenching medium is water at temperature between 25 to 40° C. (77 to 104° F.). After quenching, the cast article is aged at temperature in the range of 300 to 475° C. or 400 to 475° C. (572 to 887° F. or 752 to 842° F.) for 2 to 72 or 24 to 72 hours to achieve optimal properties.

Figure 5:
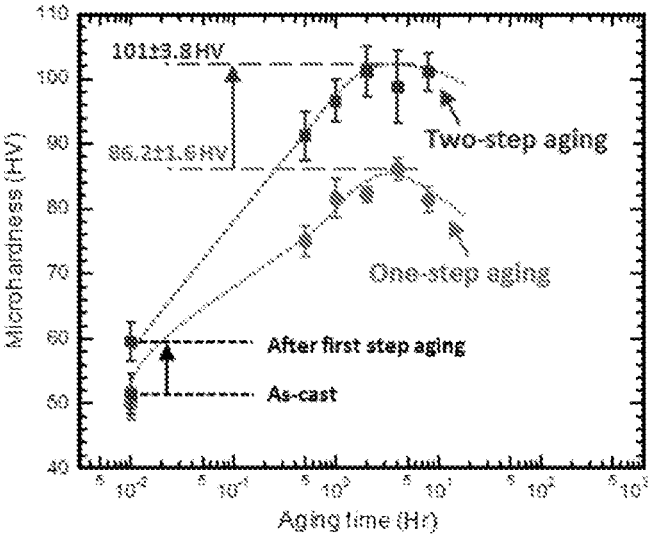
FIG. 5. is a graphical illustration of the effect of two-step aging versus one-step aging for an example of the invented aluminum alloys. For the one-step aging process, the cast article is aged at temperature in the range of 425-475° C. for 4 to 48 hours to achieve optimal properties. For the two-step aging process, in the first step, the cast article is aged at temperature in the range of 330-375° C. for 2 to 8 hours followed by the second step aging at 425-475° C. for 1 to 24 hours.

The alloy of present invention may be heat treated in one or two-step aging processes. The two-step aging is performed on cast alloys to maximize room-temperature strength. While the first step aging at lower aging temperature creates a high number density of nuclei due to the higher chemical driving force, the second step aging at higher temperature accelerates the kinetics of precipitate growth to achieve optimal strength. For the one-step aging process, the cast article can be aged at temperature in the range of 350-475° C. for 2 to 72 to achieve optimal properties. For the two-step aging process, in the first step, the cast article can be aged at temperature in the range of 330-375° C. for 2 to 24 hours followed by the second step aging at 425-475° C. for 1 to 24 hours. The effect of two-step aging versus one-step aging is presented in FIG. 5 for an invented example alloy. A noticeable increase in microhardness values is observed for the alloy aged by the two-step aging process.

The alloy of the present invention can be used in either a bulk alloy form or as an alloy matrix for producing metal matrix composite (MMC). The metal matrix composite comprises the aluminum alloy of the present invention as the alloy matrix and filler materials in the form of particles, whiskers, chopped fibers, and continuous fibers. The MMC comprising the aluminum alloy of present invention and the filler materials can be produced by common techniques such as mechanically mixing and stirring the filler materials into the molten metal (that is compo-casting or stir-casting) or using ultrasonic waves to mix and distribute the filler materials into the molten metal.

The filler materials should not be confused with $Al_6Fe$, $Al_3X$ (X=Fe, Ni) and $Al_9FeNi$ intermetallic phases or $Al_3Zr_xV_yTi_{1-x-y}$ and ($0 \le x \le 1$, $0 \le y \le 1$ and $0 \le x+y \le 1$) nano-precipitates. The average diameter of the filler materials or the reinforcement material is typically in the 1-25 microns range. The filler materials or reinforcement materials include silicon carbide (SiC), aluminum oxide ($Al_2O_3$), boron carbide ($B_4C$), boron nitride (BN), titanium carbide (TiC), yttrium oxide ($Y_2O_3$), graphite, diamond particles, and any combination of aforementioned particles. The volume fraction of the filler materials can vary up to 25% by volume.

The present invention has been described in detailed embodiments thereof. It is understood by those skilled in the art that modifications and variations in this detail may be made without departing from the spirit and scope of the claimed invention.

The invention claimed is:

1. An aluminum alloy comprising:
about 0.4 to 2% by weight iron;
0.25 to 0.8% by weight zirconium;
about 0.07 to 0.15% by weight tin, indium or antimony;
about 0.02 to 0.2% by weight silicon; and
aluminum as the remainder.

2. The aluminum alloy of claim 1, further comprising up to about 4% by weight nickel.

3. The aluminum alloy of claim 1, further comprising about 0.5 to 3.5% by weight nickel.

4. The aluminum alloy of claim 1, comprising about 0.25 to 0.55% by weight zirconium.

5. The aluminum alloy of claim 1, comprising about 0.27 to 0.42% by weight zirconium.

6. The aluminum alloy of claim 3, comprising about 0.5 to 1.5% by weight iron.

7. The aluminum alloy of claim 1, comprising about 0.82 to 1.22% by weight iron.

8. The aluminum alloy of claim 7, comprising about 0.25 to 0.55% by weight zirconium.

9. The aluminum alloy of claim 8, further comprising about 1.65 to 2.35% by weight nickel.

10. The aluminum alloy of claim 4, further comprising up to about 4% nickel by weight.

11. The aluminum alloy of claim 5, further comprising up to about 4% nickel by weight.

12. The aluminum alloy of claim 1, further comprising about 0.1 to 0.6% by weight vanadium.

13. The aluminum alloy of claim 1, further comprising about 0.1 to 2% by weight titanium.

14. The aluminum alloy of claim 1, further comprising: about 0.1 to 0.6% by weight vanadium and about 0.1 to 2% by weight titanium.

15. The aluminum alloy of claim 1, further comprising a dispersion of intermetallic $Al_6Fe$, $Al_3X$ (X=Fe, Ni) and $Al_9FeNi$ in intermetallic phases having an average diameter of about 200-600 nm.

16. The aluminum alloy of claim 1, further comprising a dispersion of $Al_3Zr_xV_yTi_{1-x-y}$ ($0 \le x \le 1$, $0 \le y \le 1$, and $0 \le x+y \le 1$) nano-precipitates, having $L1_2$ crystal structure and an average diameter in the range of about 6-40 nm.

17. The aluminum alloy of claim 1, further comprising nickel at a concentration of up to about 4% by weight and a dispersion of intermetallic $Al_6Fe$ and/or $Al_3Fe$ in intermetallic phases having an average diameter of about 200-600 nm.

18. The aluminum alloy of claim 1, further comprising nickel at a concentration of up to about 4% by weight a dispersion of intermetallic $Al_6Fe$, $Al_3X$ (X=Fe, Ni) and $Al_9FeNi$ in intermetallic phases having an average diameter of about 200-600 nm, and a dispersion of $Al_3Zr_xV_yTi_{1-x-y}$ ($0 \le x \le 1$, $0 \le y \le 1$, and $0 \le x+y \le 1$) nano-precipitates having $L1_2$ crystal structure and an average diameter in the range of about 6-40 nm.

19. The aluminum alloy of claim 18, further comprising filler materials or reinforcement materials selected from the group of materials consisting of silicon carbide (SiC), aluminum oxide ($Al_2O_3$), boron carbide ($B_4C$), boron nitride (BN), titanium carbide (TiC), yttrium oxide ($Y_2O_3$), graphite, diamond particles, and their mixtures, the volume fraction of the filler materials comprising up to about 25% by volume of the metal matrix.

20. The aluminum alloy of claim 1, further comprising a dispersion of intermetallic $Al_6Fe$ and/or $Al_3Fe$ in intermetallic phases having an average diameter of about 200-600 nm and a dispersion of $Al_3Zr_xV_yTi_{1-x-y}$ ($0 \le x \le 1$, $0 \le y \le 1$, and $0 \le x+y \le 1$) nano-precipitates having $L1_2$ crystal structure and an average diameter in the range of about 6-40 nm.

21. The aluminum alloy of claim 20, further comprising filler materials or reinforcement materials selected from the group of materials consisting of silicon carbide (SiC), aluminum oxide ($Al_2O_3$), boron carbide ($B_4C$), boron nitride (BN), titanium carbide (TiC), yttrium oxide ($Y_2O_3$), graphite, diamond particles, and their mixtures, the volume fraction of the filler materials comprising up to about 25% by volume.

22. The aluminum alloy of claim 1 lacking scandium.

23. The aluminum alloy of claim 1, having a compression yield of at least about 55 MPa at a testing temperature of about 375° C.

24. The aluminum alloy of claim 1, having a compression strength of at least about 60 MPa at a testing temperature of about 375° C.

25. The aluminum alloy of claim 1, having a thermal conductivity at about 20° C. that is at least about 185 W/m·K.

26. The aluminum alloy of claim 1, which retains its room temperature strength after at least 7 months exposure to a temperature of about 375° C.

27. A cast aluminum article comprising the aluminum alloy of claim 1.

28. The cast aluminum article of claim 27, further comprising a dispersion of intermetallic $Al_6Fe$, $Al_3X$ (X=Fe, Ni) and $Al_9FeNi$ in intermetallic phases having an average size range of about 200-600 nm and a dispersion of $Al_3Zr_xV_yTi_{1-x-y}$ ($0 \leq x \leq 1$, $0 \leq y \leq 1$, and $0 \leq x+y \leq 1$) nano-precipitates having $L1_2$ crystal structure and an average size range of about 6-40 nm.

29. A method for manufacturing an aluminum alloy comprising the steps of casting an aluminum alloy mixture at about 750 to 950° C., the aluminum alloy mixture comprising:

about 0.4 to 2% by weight iron;

about 0.1 to 0.8% by weight zirconium;

about 0.07 to 0.15% by weight tin, indium or antimony;

about 0.02 to 0.2% by weight silicon;

an inoculant selected from the group consisting of Sn, In, Sb and their mixtures; and aluminum as the remainder;

quenching the cast alloy after solidification; and heat aging the cast article at a temperature in the range of about 300 to 450° C. for about 2 to 72 hours.

30. The method claim 29, wherein the heat aging is at about 400 to 450° C. for about 24 to 72 hours.

31. The method of claim 29, wherein the alloy mixture lacks scandium.

* * * * *